United States Patent [19]

Foltyn et al.

[11] 4,241,764

[45] Dec. 30, 1980

[54] SAND ROLLER CONTROL MECHANISM FOR LOOMS

[75] Inventors: Jan Foltýn; Jindřich Henzl; Otto Rotrekl, all of Brno; Vladimir Kuda, Blazovice, all of Czechoslovakia

[73] Assignee: Vyzkumny a vyvojovy ustav Zavodu vaseobecneho strojirenstvi, Brno, Czechoslovakia

[21] Appl. No.: 943,642

[22] Filed: Sep. 19, 1978

Related U.S. Application Data

[63] Continuation-in-part of Ser. No. 857,708, Dec. 5, 1977, abandoned.

[30] Foreign Application Priority Data

Dec. 3, 1976 [CS] Czechoslovakia ..... 7871-76

[51] Int. Cl.[3] ..... D03D 49/20

[52] U.S. Cl. ..... 139/1 R; 139/1 E; 139/304

[58] Field of Search ..... 139/24, 99, 100, 304, 139/309, 307, 97, 1 R, 1 E; 66/149 R, 153; 242/55

[56] References Cited

U.S. PATENT DOCUMENTS

| | | | |
|---|---|---|---|
| 3,265,094 | 8/1966 | Baird | 139/1 R |
| 3,318,341 | 5/1967 | Nollet | 139/1 E |
| 3,525,367 | 8/1970 | Sprague | 139/304 |
| 3,934,620 | 1/1976 | Garcia | 139/304 |

*Primary Examiner*—Henry Jaudon

[57] ABSTRACT

There is disclosed a control mechanism for the sand rollers of looms. The output of the cloth take-up motion of a loom is drivingly connected to a first input shaft of a differential gearing mechanism, and the second input shaft of the differential gearing mechanism is drivingly connected to the output shaft of an electric motor. The electric motor is under the control of a mechanism which selectively permits its starting and stopping. The output shaft of the differential gearing mechanism is drivingly connected to the sand roller. The electric motor is preferably of the reversible type, the means for controlling the motor then including means for selectively reversing the motor. During the ordinary operation of the loom, the sand roller is driven by the cloth take-up motion through the differential mechanism, the electric motor being then switched off and locked. Only when the tensioning or slacking off of the fabric is required is the electric motor started in the required direction after the loom has been stopped.

3 Claims, 4 Drawing Figures

SAND ROLLER CONTROL MECHANISM FOR LOOMS

This application is a continuation-in-part of now abandoned application Ser. No. 857,708, filed Dec. 5, 1977.

The present invention relates to a control mechanism for the sand roller of a loom.

In hitherto known mechanisms for driving sand rollers in looms, the cloth take-up motion is driven from the loom, said take-up motion functioning, via a mechanical transmission, to withdraw the fabric by the sand roller, and usually also to wind the fabric onto a cloth beam. Upon stoppage of the loom, it is possible to disengage the connection between the cloth take-up motion and the sand roller and to rotate the sand roller by a hand wheel via a transmission so as to wind or unwind the fabric. This manual winding and unwinding of the fabric is carried out, among other reasons, to reduce damage to the fabric such as "barriness" of the fabric in the weft direction, which arises upon the starting of the loom.

A disadvantage of this prior arrangement is that the operations performed during the winding or unwinding of the fabric require very considerable physical force and their successful performance depends upon the skill of the attendant.

Such disadvantage is mitigated by the sand roller control mechanism for looms according to the present invention. In such mechanism the output of the cloth take-up motion is connected to the first input of a differential gearing mechanism, the second input of the differential gearing mechanism being drivingly connected, as by a first mechanical transmission, to the output of an electric motor which is selectively started and stopped by means of a control circuit. The output of the differential gearing mechanism is drivingly connected to the sand roller, as by a second mechanical transmission.

The invention will be more readily understood by reference to the accompanying drawings, in which.

Figure 1:
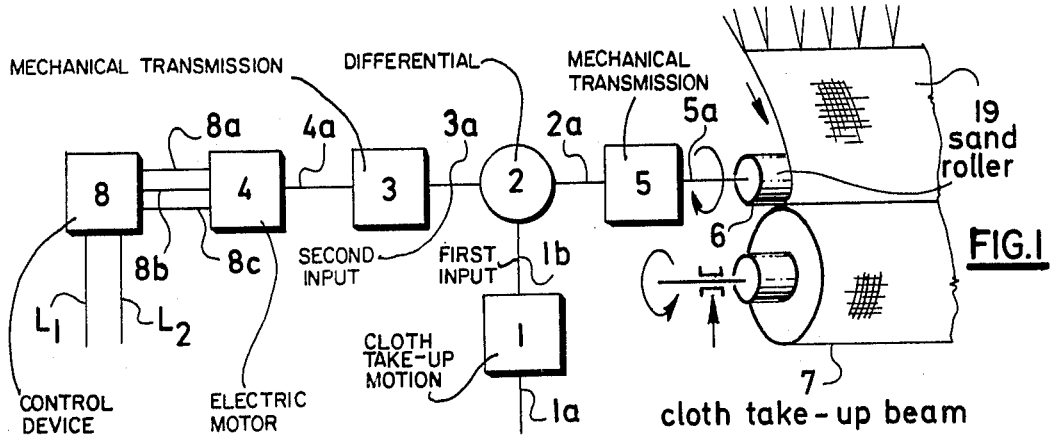
FIG. 1 is a schematic layout of the arrangement of the mechanism of the present invention for driving and controlling the sand roller of the loom.

Referring now to FIG. 1, a cloth take-up motion 1 is drivingly mechanically connected to a driven shaft 1*a* of a loom (not shown), the output shaft 1*b* of the cloth take-up motion being drivingly connected to the first input of a differential gearing mechanism 2. Mechanism 2 is of conventional design, and may be similar to the well-known differential gear employed in automobiles. A second input shaft 3*a* of the differential gearing mechanism 2 is drivingly connected by a first mechanical transmission 3 to the output or diving shaft 4*a* of an electric motor 4. The output shaft 2*a* of the differential gearing mechanism 2 is connected to sand roller 6 via a second mechanical transmission 5. As shown, the sand roller 6 withdraws a fabric 19 from a loom (not shown) provided with the above referred to driven shaft 1*a* and forwards it to a driven cloth take-up beam 7. The mechanical transmissions 3 and 5 may be gearboxes which reduce the speed of rotation transmitted therethrough from the input to the output shaft thereof.

The electric motor 4 is powered from a source (not shown) through wires $L_1$, $L_2$, as shown, such wires leading to a control device 8 for the motor. Motor 4 is preferably of a conventional reversible type, the control device 8 being connected thereto by wires 8*a*, 8*b*, and 8*c*. The control device 8 includes conventional means which permit the manual starting and stopping of the motor as well as its selective reversal. Means 8 may also include means which automatically starts the motor after a starting button has been depressed.

During the ordinary operation of the loom, the sand roller 6 is driven by a machine drive (notshown), in the direction of the arrows, via the cloth take-up motion 1, the differential gearing mechanism 2 and the second mechanical transmission 5. The electromotor 4 is switched off and locked. Only when tensioning or slacking of the fabric is required the electromotor 4 may be set going after the loom has been stopped.

The above described apparatus operates as follows:

The cloth take-up motion 1 is driven by the rotary motion derived from the loom drive, and its output drives the first input 1*b* of differential gearing mechanism 2. The second input 3*a* of differential gearing mechanism 2 is driven via the first mechanical transmission 3 by the electric motor 4. The output 2*a* of the differential gearing mechanism 2 drives, via the second mechanical transmission 5, the sand roller 6.

The control device 8, which as above mentioned, selectively starts and stops the electric motor 4 and selectively reverses it when required. As above indicated, device 8 may also include an automatically controlled program switch, either separately or advantageously in combination, whereby the starting of the motors initiated by the mere pressing of a button. The manually operated program switch, upon being switched on, starts the electric motor 4 which is allowed to run for the time necessary for the optimum winding or unwinding of the fabric produced by the loom. Device 8 may also include an automatic program switch which operates automatically upon the starting or stopping of the loom.

Differential gearing mechanism 2 is connected in such manner that the angular velocity of its output shaft is proportional to the sum of the angular velocities of its input shafts. Accordingly when the electric motor 4 is at rest the sand roller 6 is driven only by the shaft 1*a* of the loom. When the loom is stopped, sand roller 6 is driven only by the electric motor 4. The direction of rotation of the sand roller 6 by the motor 4 can be changed by the motor reversing means contained in control device 8.

In either of the two cases mentioned above, that is the driving of the sand roller 6 solely by the shaft 1*a*, and the driving of the sand roller 6 solely by electric motor 4, it is not necessary to interrupt the mechanical coupling between the cloth take-up motion 1 and the sand roller 6 or between the electric motor 4 and the sand roller 6. A further advantage of the control mechanism for the sand roller according to the present invention is that it relieves the loom attendant of the necessity of manually winding or unwinding the fabric on the cloth take-up beam 7. Further, the time for performing this operation is shortened, the requirement as to the skill of the loom attendant is reduced, and the possibility of damage to the fabric, by reducing the "barriness" of the fabric in the weft direction is reduced. The electric motor 4 is naturally locked-off during the normal operation of the loom. However, to prevent "barriness" of the fabric, it is preferred that the motor 4 also be in action during the starting and the running down of the loom .

Figure 2:
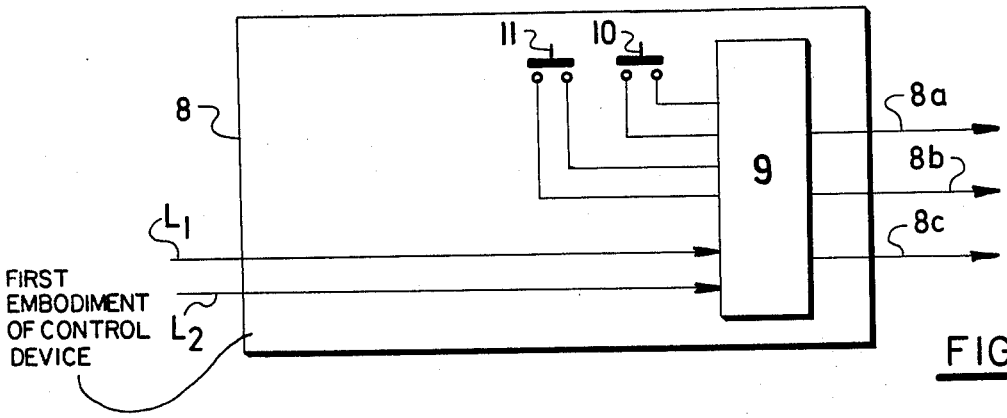
FIG. 2 is a circuit diagram of a first embodiment of control device for use in the mechanism of the invention.

In FIG. 2 there is shown a first embodiment of the control device 8.

The controlling device 8 here shown comprises two manually operated press-buttons 10 and 11 and a relay device 9 which serves to switch the motor 4 on and off. The direction of rotation of the motor 4 depends on which of the buttons 10 and 11 is operated.

After having been started by the operation of one of buttons 10, 11, the motor 4 runs in a selected direction of rotation for a predetermined time period required for the optimum tensioning or slacking off of the fabric.

Figure 3:
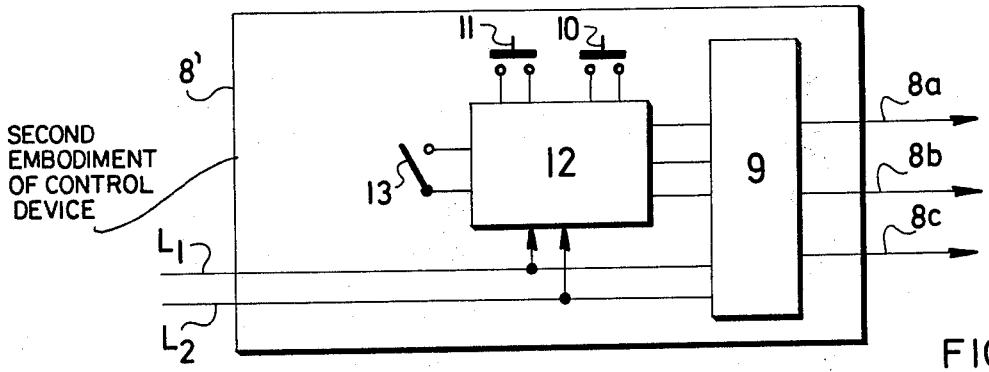
FIG. 3 is a circuit diagram of a second embodiment of such control device.

In FIG. 3 there is shown a second embodiment of the control device, here designated 8'. The controlling device 8' is similar to device 8 of FIG. 2, but in addition includes a manually operated program switch 12 and a manually operated single, pole, single throw switch 13. The switch 12 comprises e.g. a timing circuit (not shown) which upon pressing of one of the buttons 10, 11, starts the motor 4 running in the desired direction.

Switch 12 may comprise a fabric tension detector (not shown), a detector of the amount of turning of the output shaft of the motor 4, or the amount of turning of the sand roller 6. In any of these latter cases the motor 4 is automatically switched off after the required tension of the fabric has been achieved, or when the predetermined desired turning of the various specified elements has been reached. Upon the closing of the switch 13, the program section of the program switch is put out of action and the controlling device 8' functions in the same manner as device 8, shown in FIG. 2.

Figure 4:
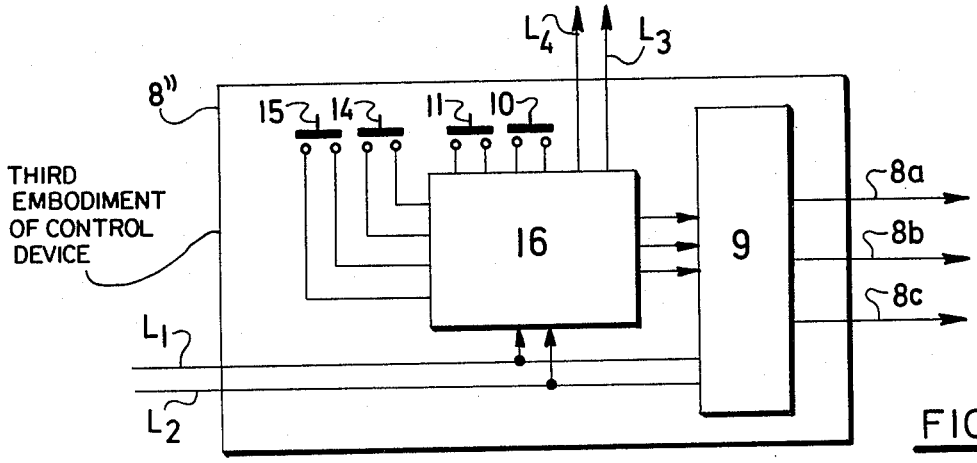
FIG. 4 is a circuit diagram of a third embodiment of such device.

A third embodiment of control device, designated 8'', is shown in FIG. 4. In addition to the parts shown in device 8 in FIG. 2, the control device 8'' has an automatically controlled program switch 16, two manually operated press-buttons 14, 15, and output lead $L_3$, $L_4$.

The automatically controlled program switch 16 may comprise a timing circuit of the detector, as described in connection with the switch 12 of FIG. 3. The press-buttons 10, 11 control the action and the direction of rotation of the motor 4 without dependence upon the program of the switch 16. The press-buttons 14 and 15 serve to start and stop the loom.

Upon pressing the button 14, the program switch 16 sets the motor 4 going and keeps it in operation for a predetermined time needed for the optimum tensioning of the fabric. After this operation has been finished, the motor 4 is switched off and the motor which drives the loom is automatically switched on by means of the leads $L_3$, $L_4$. The button 15 has just the reverse function: when pressed it causes the loom to stop, and automatically loosens the fabric.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a loom provided with a drive shaft driven in synchronism therewith, the loom having a cloth take-up motion, a sand roller, and a cloth take-up beam, the improvement which comprises a control mechanism for the sand roller, said control mechanism comprising a differential gearing mechanism having first and second input shafts and an output shaft, the first input shaft of the differential gearing mechanism is drivingly connected to the cloth take-up motion, an electric motor having an output shaft, means drivingly connecting the output shaft of the motor to the second input shaft of the differential gearing mechanism, means drivingly connecting the output shaft of the differential gearing mechanism to the sand roller, a source of electric power, and a mechanism for controlling the electric motor comprising circuit means for connecting the electric motor comprising circuit means for connecting the electric motor to the source of electric power when the loom is stopped, so that the sand roller is then driven only by the electric motor, and means for disconnecting the electric motor from the source of electric power during normal operation of the loom, so that the electric motor is then at rest and the sand roller is driven only by the said drive shaft of the loom.

2. Apparatus as claimed in claim 1, wherein the mechanism for controlling the electric motor includes means for selectively reversing the motor.

3. Apparatus as claimed in claim 1, wherein the means connecting the second input shaft of the differential gearing mechanism to the electric motor and the means for connecting the output shaft of the differential gearing mechanism to the sand roller, respectively, each comprises gear transmissions.

* * * * *